US010825629B2

(12) United States Patent
Gutmann et al.

(10) Patent No.: US 10,825,629 B2
(45) Date of Patent: Nov. 3, 2020

(54) MONOLITHIC CARRIER BODY FOR A RELAY

(71) Applicant: Tyco Electronics Austria GmbH, Vienna (AT)

(72) Inventors: Markus Gutmann, Brand (AT); Rudolf Mikl, Maria Ellend (AT); Paul Indrajit, Markdorf (DE)

(73) Assignee: Tyco Electronics Austria GmbH, Vienna (AT)

( * ) Notice: Subject to any disclaimer, the term of this patent is extended or adjusted under 35 U.S.C. 154(b) by 230 days.

(21) Appl. No.: 15/660,272

(22) Filed: Jul. 26, 2017

(65) Prior Publication Data

US 2017/0323748 A1 Nov. 9, 2017

Related U.S. Application Data

(63) Continuation of application No. PCT/EP2016/052002, filed on Jan. 29, 2016.

(30) Foreign Application Priority Data

Jan. 30, 2015 (EP) ..... 15153206

(51) Int. Cl.
*H01H 50/02* (2006.01)
*H01H 50/04* (2006.01)
(Continued)

(52) U.S. Cl.
CPC ..... *H01H 50/02* (2013.01); *H01H 50/04* (2013.01); *H01H 50/16* (2013.01); *H01H 50/44* (2013.01); *H01H 50/026* (2013.01); *H01H 50/56* (2013.01); *H01H 50/642* (2013.01); *H01H 2050/446* (2013.01)

(58) Field of Classification Search
CPC ..... H01H 50/02; H01H 50/026; H01H 2050/028; H01H 50/04; H01H 50/16; H01H 50/44; H01H 50/56; H01H 2050/446; H01H 50/642
See application file for complete search history.

(56) References Cited

U.S. PATENT DOCUMENTS 5,274,348 A * 12/1993 Vernier ..... H01H 51/005 335/160
5,790,004 A 8/1998 Matsuoka et al.
(Continued)

FOREIGN PATENT DOCUMENTS

CN 1163472 A 10/1997
CN 1393902 A 1/2003
(Continued)

OTHER PUBLICATIONS

PCT Notification, International Search Report and Written Opinion of the International Searching Authority, dated Apr. 3, 2016, 13 pages.
(Continued)

*Primary Examiner* — Ramon M Barrera
(74) *Attorney, Agent, or Firm* — Barley Snyder

(57) ABSTRACT

A carrier body for a relay comprises a base body, a coil carrier, and a contact mount. The base body is monolithically formed with the coil carrier and the contact mount. The coil carrier and the contact mount extend from the base body.

18 Claims, 2 Drawing Sheets

(51) Int. Cl.

| | |
|---|---|
| ***H01H 50/16*** | (2006.01) |
| ***H01H 50/44*** | (2006.01) |
| *H01H 50/56* | (2006.01) |
| *H01H 50/64* | (2006.01) |

(56) References Cited

U.S. PATENT DOCUMENTS

| | | | | |
|---|---|---|---|---|
| 6,144,270 | A * | 11/2000 | Mader | H01H 50/24 335/78 |
| 7,876,184 | B2 | 1/2011 | Mikl et al. | |
| 8,816,800 | B2 | 8/2014 | Mikl | |
| 2003/0016104 | A1 | 1/2003 | Mader et al. | |
| 2007/0257752 | A1 | 11/2007 | Mikl et al. | |
| 2012/0154077 | A1 | 6/2012 | Mikl | |

FOREIGN PATENT DOCUMENTS

| | | | |
|---|---|---|---|
| CN | 101106041 | B | 7/2012 |
| CN | 102568937 | A | 7/2012 |
| EP | 1271593 | A2 | 1/2003 |
| EP | 2466608 | A2 | 6/2012 |
| JP | 2003-045309 | A | 2/2003 |
| JP | 2005-166431 | A | 6/2005 |
| WO | 2015005314 | A1 | 1/2015 |

OTHER PUBLICATIONS

European Search Report, dated Aug. 7, 2015, 6 pages.
Chinese First Office Action with English translation, dated Jun. 26, 2018, 16 pages.
Notice of Reasons for Refusal, English translation, dated Apr. 6, 2018, 4 pages.
Abstract of JP2005166431A, dated Jun. 23, 2005, 1 page.
Chinese Third Office Action with English translation, Chinese Patent Application No. 201680007299.0, dated Sep. 9, 2019, 18 pages.

* cited by examiner

MONOLITHIC CARRIER BODY FOR A RELAY

CROSS-REFERENCE TO RELATED APPLICATIONS

This application is a continuation of PCT International Application No. PCT/EP2016/052002, filed on Jan. 29, 2016, which claims priority under 35 U.S.C. § 119 to European Patent Application No. 15153206.6, filed on Jan. 30, 2015.

FIELD OF THE INVENTION

The invention relates to a carrier body and, more particularly, to a monolithic carrier body for a relay.

BACKGROUND

Known electrical relays often comprise carrier bodies to which the parts of the relay are mounted. Such carrier bodies have a base body to which the relay elements are attached. However, in order to improve the electrical insulation, it is often necessary to add additional insulation elements to the carrier body.

SUMMARY

A carrier body for a relay according to the invention comprises a base body, a coil carrier, and a contact mount. The base body is monolithically formed with the coil carrier and the contact mount. The coil carrier and the contact mount extend from the base body.

BRIEF DESCRIPTION OF THE DRAWINGS

The invention will now be described by way of example with reference to the accompanying figures, of which.

DETAILED DESCRIPTION OF THE EMBODIMENTS

Figure 1:
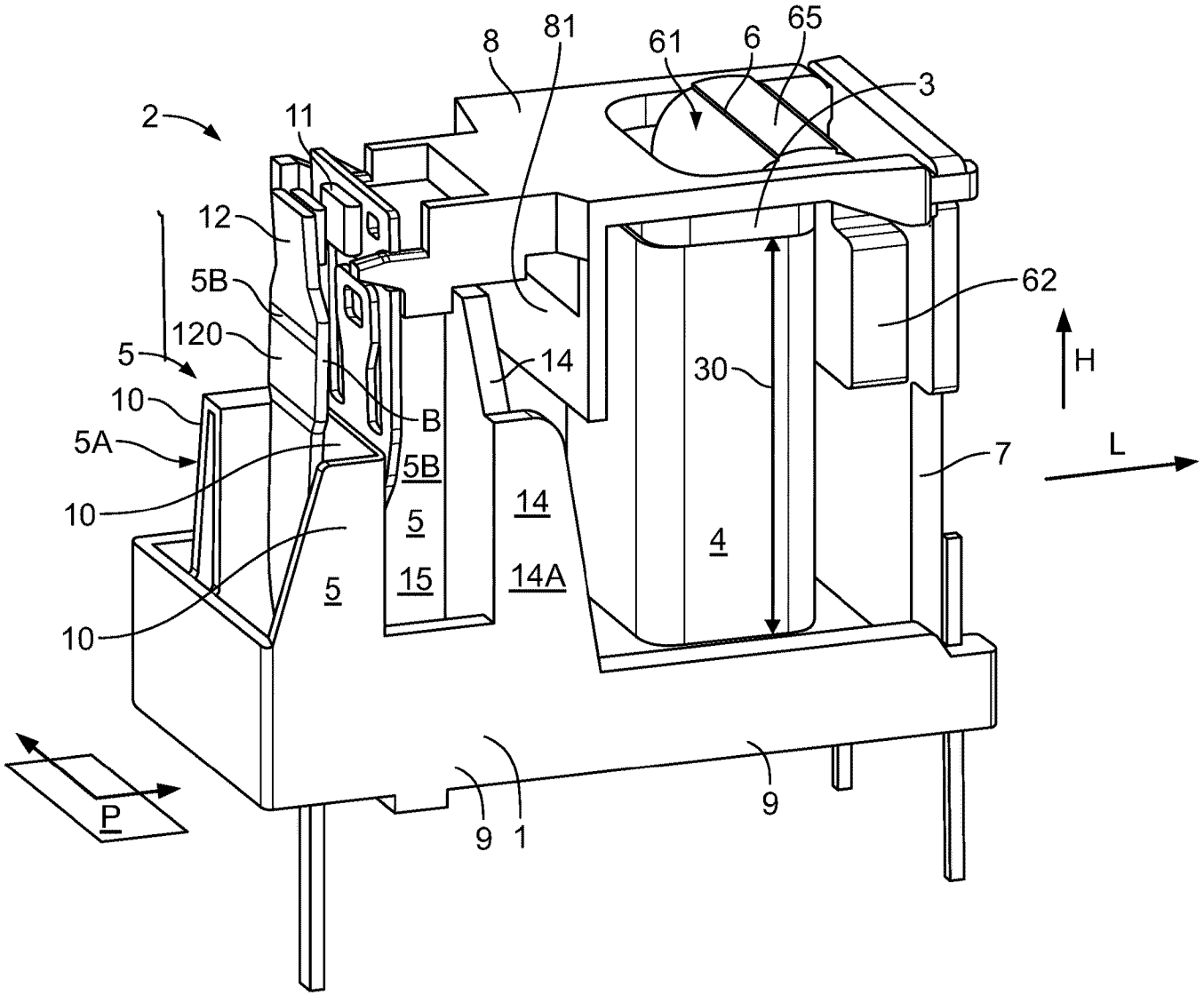
FIG. 1 is a perspective view of a carrier body according to an embodiment of the invention with a relay.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

A carrier body 1 for a relay 2 according to an embodiment of the invention is shown in FIG. 1. The carrier body 1 comprises a coil carrier 3, a plurality of contact mounts 5, a base body 9, and an insulation wall 14. The relay 2 comprises the carrier body 1, a coil 4, a yoke 6, an armature 7, a coupling 8, a first contact 11, a second contact 12, and a mounting member 15. The relay 2 can comprise further elements like housings or covers that are not shown in FIG. 1. The carrier body 1 supports some parts of the relay 2.

The coil carrier 3, as shown in FIG. 1, holds the coil 4; windings of the coil 4 are wound around the coil carrier 3.

The coil carrier 3 has the shape of a tower with four side walls and a rectangular cross-section. The coil carrier 3 is hollow in its center.

The yoke 6, as shown in FIG. 1, is inserted into the hollow space of the coil carrier 3. The yoke 6 has a U-shape with a first leg 61 of the U disposed in the center of the coil carrier 3 and a second leg 62 disposed outside the coil carrier 3 and parallel to the first leg 61. The two legs 61, 62 are connected to each other via a bend 65. When the coil 4 is energized, current flows through the coil 4 and a magnetic flux is generated which is conducted by the yoke 6 to the second leg 62.

The armature 7 of the relay 2 switches a load circuit and can be switched from an open position shown in FIG. 1 to a closed position by running a current through the coil 4. The armature 7 is then pulled towards the second leg 62 and the movement of the armature 7 is transmitted via the coupling 8 to the first contact 11. Depending on whether the coil 4 is energized or not, the armature 7 is moved to the open or closed position and, consequently, the first contact 11 is either in contact or apart from the second contact 12 of the load circuit.

The plurality of contact mounts 5, as shown in FIG. 1, mount and hold the first and the second contact 11, 12. The contact mounts 5 are integral with the base body 9 of the carrier body 1. The base body 9 has a planar configuration in the shape of a short board.

The coil carrier 3 and the contact mounts 5 extend from the base body 9 approximately perpendicular to the base body 9. The coil carrier 3 and the contact mounts 5 are monolithically formed with the base body 9 and the entire carrier body 1 is monolithic. In an embodiment, the carrier body 1 is formed from injection molded plastic. The coil 4 and the contacts 11, 12 are supported by the coil carrier 3 and contact mounts 5 along an extended distance and no further elements have to be added to the carrier body 1 to improve the mechanical stability of the coil 4 and the contacts 11, 12.

A first contact mount 5A of the contact mounts 5, as shown in FIG. 1, has a channel shape open to an upper side and to an outer side. The first contact mount 5A has a U-shaped cross-section parallel to a plane P of the base body 9. The first contact mount 5A comprises three side walls 10 which form the channel. A first side wall 10 is located between the second contact 12 and the first contact 11 and thus insulates the contacts 11, 12 from each other. Two second side walls 10 are located at the sides of the first side wall 10. These second side walls 10 extend parallel to a longitudinal direction L that extends from the contacts 11, 12 to the coil 4. The second side walls 10 are directly connected to the base plate 9 to allow a good force transmission and thus provide good support for the second contact 12. The second side walls 10, which are the legs of the U-shaped cross-section, extend partially around the second contact 12. The second contact 12 has an elastic flexibility and acts as a second contact spring 120. The second wall sections 10 extend perpendicular with respect to the contact spring 120.

A second contact mount 5B of the contact mounts 5, as shown in FIG. 1, is disposed between the first contact 11 and the coil 4. The second contact mount 5B supports the first contact 11 when the first contact 11 is in an open position and does not contact the second contact 12. The first contact 11 has an elastic flexibility and acts as a first contact spring 110. The contact spring 110 is mounted on the contact mount 5B and the mounting member 15 with the contact spring 110 is spaced apart from the base body 9. The second contact mount 5B has a tower shape with a rectangular cross-section.

The first contact mount 5A and the second contact mount 5B, as shown in FIG. 1, both extend over more than half a height 30 of the coil carrier 3, the height 30 being measured in a height direction H that is perpendicular to the plane P of the base body 9. The first contact mount 5A is only slightly larger than half the height 30 of the coil carrier 3. The second contact mount 5B is higher and extends over about ⅞ of the height 30 of the coil carrier 3. This allows good mechanical stability and additionally makes the possible paths for leaking currents between the loaded circuit and the coil 4 longer so that additional insulating elements are unnecessary.

The insulation wall 14 of the carrier body 1, as shown in FIG. 1, is monolithically formed with the base body 9 and extends from the base body 9 between the coil carrier 3 and the contact mounts 5. Possible paths for leak currents between the contacts 11, 12 and the coil 4 are elongated further by the insulation wall 14. Moreover, a connection through air is further impeded via the insulation wall 14. To even further impede a possible conduction through air, the coupling 8 has a shield 81 that protrudes from the upper side into a gap between the coil 4 and the contacts 11, 12.

As shown in FIG. 1, the insulation wall 14 has, like the first contact mount 5A, wall sections 14A that extend along the longitudinal direction L. The wall sections 14A make the possible paths for leak currents longer and additionally provide good force distribution and good support for the insulation wall 14, as the wall sections 14A are directly connected to the base body 9. In contrast to the second side walls 10 of the first contact mount 5A, the wall sections 14A extend toward the coil 4, providing stability for the second contact mount 5B against tilting toward the coil 4. In the shown embodiment, the wall sections 14A are wings of the insulation wall 14. A central part of the insulation wall 14 is also a wall of the second contact mount 5B, providing a compact design. The coupling 8, as shown in FIG. 1, rests slidably on the insulation wall 14 and, consequently, further guiding or bearing elements are unnecessary.

Figure 2:
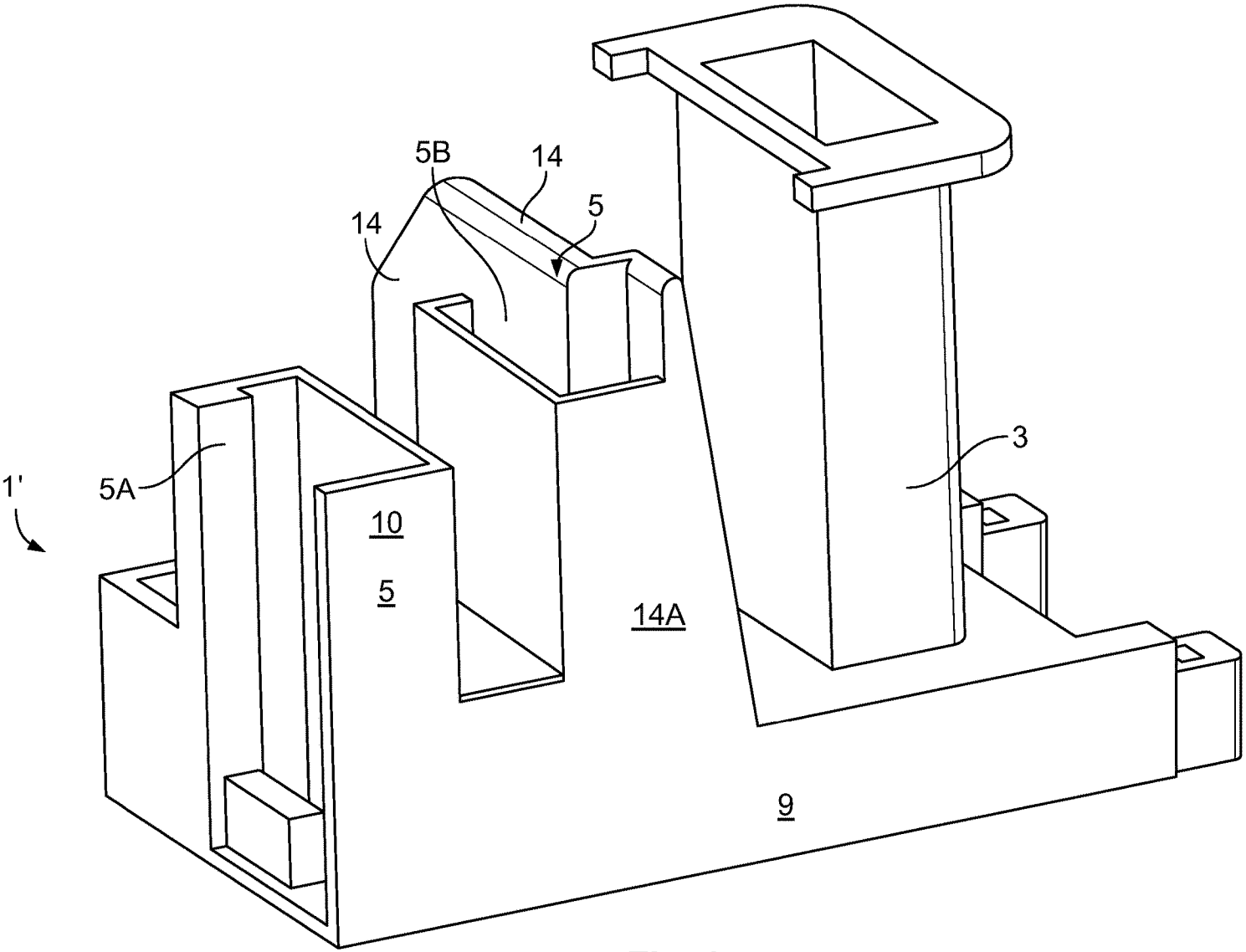
FIG. 2 is a perspective view of a carrier body according to another embodiment of the invention.

A carrier body 1' according to another embodiment of the invention is shown in FIG. 2. Like reference numerals indicate like elements and only differences from the carrier body 1 shown in FIG. 1 will be described herein. In the carrier body 1', the second contact mount 5B is closed to all four sides by the insulation wall 14 and is only open toward the upper side to allow insertion of the first contact 11.

What is claimed is:

1. A carrier body for a relay, comprising:

a base body monolithically formed with a coil carrier around which a coil is wound and a contact mount, the coil carrier and the contact mount extending from the base body, the contact mount extends over more than half a height of the coil carrier in a height direction perpendicular to a plane of the base body.

2. The carrier body of claim 1, wherein an insulation wall is monolithically formed with the base body.

3. The carrier body of claim 2, wherein the insulation wall extends from the base body between the coil carrier and the contact mount.

4. The carrier body of claim 1, wherein the contact mount has a tower shape or a channel shape.

5. The carrier body of claim 1, wherein the contact mount has a U-shaped cross-section.

6. The carrier body of claim 5, wherein the contact mount extends partially around a contact spring disposed in the contact mount.

7. The carrier body of claim 2, wherein the insulation wall has a wall section extending along a longitudinal direction of the carrier body.

8. A relay, comprising:

a carrier body including a base body monolithically formed with a coil carrier around which a coil is wound, a contact mount, and an insulation wall, the coil carrier, the contact mount, and the insulation wall extending from the base body with the insulation wall disposed between the coil carrier and the contact mount, the contact mount extends over more than half a height of the coil carrier in a height direction perpendicular to a plane of the base body.

9. The relay of claim 8, further comprising a coupling slidably disposed on the insulation wall.

10. The relay of claim 8, further comprising a mounting member of a first contact spring spaced apart from the base body.

11. The relay of claim 10, further comprising a second contact spring mounted on the contact mount of the insulation wall.

12. A relay, comprising:

a carrier body including (a) a base body, (b) a coil carrier monolithically formed with the base body and extending perpendicularly with respect to the base body, (c) a first contact mount monolithically formed with the base body and extending perpendicularly with respect to the base body, the first contact mount having a U-shaped cross-section parallel to a plane of the base body, and (d) a second contact mount monolithically formed with the base body and extending perpendicularly with respect to the base body, the second contact mount disposed between the first contact mount and the coil carrier and having a rectangular cross-section parallel to a plane of the base body, each of the first contact mount and the second contact mount extends over more than half a height of the coil carrier in a height direction perpendicular to the plane of the base body;

a first contact disposed in the first contact mount; and a second contact disposed in the second contact mount, a first side wall of the first contact mount disposed between the first contact and the second contact.

13. The relay of claim 12, further comprising a coil disposed around the coil carrier.

14. The relay of claim 13, further comprising a yoke formed in a U-shape and having a first leg disposed in a center of the coil carrier and a second leg disposed outside of the coil carrier.

15. The relay of claim 14, further comprising an armature connected to the second leg of the yoke and connected to the first contact via a coupling, the armature moving the first contact with an energizing of the coil between a closed position of the first contact and the second contact and an open position of the first contact and the second contact.

16. The relay of claim 12, wherein the carrier body includes an insulation wall monolithically formed with the base body and extending perpendicularly with respect to the base body, the insulation wall disposed between the coil carrier and the second contact mount.

17. The relay of claim 16, wherein the first contact mount has a pair of second side walls extending from the first side wall and along a longitudinal direction of the carrier body away from the second contact mount.

18. The relay of claim 17, wherein the insulation wall has a wall section extending along a longitudinal direction of the carrier body toward the coil carrier.

* * * * *